United States Patent [19]

Parker

[11] 4,205,631

[45] Jun. 3, 1980

[54] PRESSURE LIMITING CONTROL FOR AN INLET DRAFT FAN IN AN ELECTRIC POWER PLANT

[75] Inventor: Larry R. Parker, O'Hara Township, Allegheny County, Pa.

[73] Assignee: Westinghouse Electric Corp., Pittsburgh, Pa.

[21] Appl. No.: 950,357

[22] Filed: Oct. 11, 1978

[51] Int. Cl.[2] ..... F27D 7/06

[52] U.S. Cl. ..... 122/4 R; 110/162; 236/15 C

[58] Field of Search ..... 122/4 R, 4 A; 110/162; 236/14, 15 C, 15 B

[56] References Cited

U.S. PATENT DOCUMENTS

| | | | |
|---|---|---|---|
| 3,416,470 | 12/1968 | Hey et al. | 110/162 |
| 3,736,360 | 5/1973 | Bergman et al. | 236/15 C X |
| 3,739,484 | 6/1973 | Wilkening et al. | 236/15 C X |
| 3,889,877 | 6/1975 | Kivlen | 236/15 C |
| 3,964,675 | 6/1976 | Euchner | 236/15 C |
| 3,985,294 | 10/1976 | Guido et al. | 236/15 C |

*Primary Examiner*—Edward G. Favors
*Attorney, Agent, or Firm*—E. F. Possessky

[57] ABSTRACT

The inlet vanes for an induced draft (ID) fan in a power plant boiler are position controlled in accordance with the furnace pressure to limit the potential destructive power developed by the fan. The ID inlet suction temperature is sensed and a control signal is developed as a function of the inlet temperature to limit the opening of the inlet vanes during boiler startup.

10 Claims, 2 Drawing Figures

FINAL POSITION DEMAND SIGNAL
OPERATOR CONTROL
44
MANUAL/AUTOMATIC STATION
40
MULTIPLIER
42
ACTUATOR POSITION CONTROLLER
38
FUNCTION GENERATOR
48
100%
f(x)
30%
$t_1$
$t_2$
TIME
MULTIPLIER
36
INVERTER
50
TEMPERATURE TRANSDUCER
46
32
COMPUTING AMPLIFIER
34
FURNACE PRESSURE SENSOR
28
PRESSURE SET POINT
INLET SUCTION TEMPERATURE SENSOR
30

PRESSURE LIMITING CONTROL FOR AN INLET DRAFT FAN IN AN ELECTRIC POWER PLANT

BACKGROUND OF THE INVENTION

The present invention relates to electric power plants and more particularly to ID fan controls employed therein.

The boiler in an electric power plant usually includes one or more forced draft (FD) fans which drive air into the boiler for combustion purposes and one or more induced draft (ID) fans which draw combustion products out of the boiler for cleanup and discharge. It is generally desirable to coordinate the control of the FD and ID fans so that the internal furnace pressure is slightly negative to avoid outflow of combustion products directly to the atmosphere through small furance openings which may exist. The furnace normally has sufficient structural strength to withstand suction pressures substantially greater than that associated with normal furnace operation.

During boiler startup, furnace suction pressure excursions as high as 30 to 50 inches water can occur quickly, particularly in view of the lower temperature and increased density of the air during startup. The magnitude of the suction pressure excursion can be so great that a costly and hazardous furnace implosion would occur. The possibility of an implosion is greater with the larger more recent boiler and ID fans because the destructive fan suction force increases significantly with larger ID fans. Implosion possibilities also are greater in cases where ID fans are retrofitted to older boilers which typically have less structural strength than do the more modern boilers. It is therefore desirable that an ID fan control be provided to limit suction pressure excursions during startup in a safe and reliable manner.

SUMMARY OF THE INVENTION

A control system for a power plant boiler includes means for controlling ID inlet vane position so that furnace pressure is regulated to satisfy a setpoint. To maintain safe operational limits during startup, means are provided for sensing the ID fan inlet air temperature and for limiting the opening of the ID inlet vanes.

DESCRIPTION OF THE PREFERRED EMBODIMENT

Figure 1:
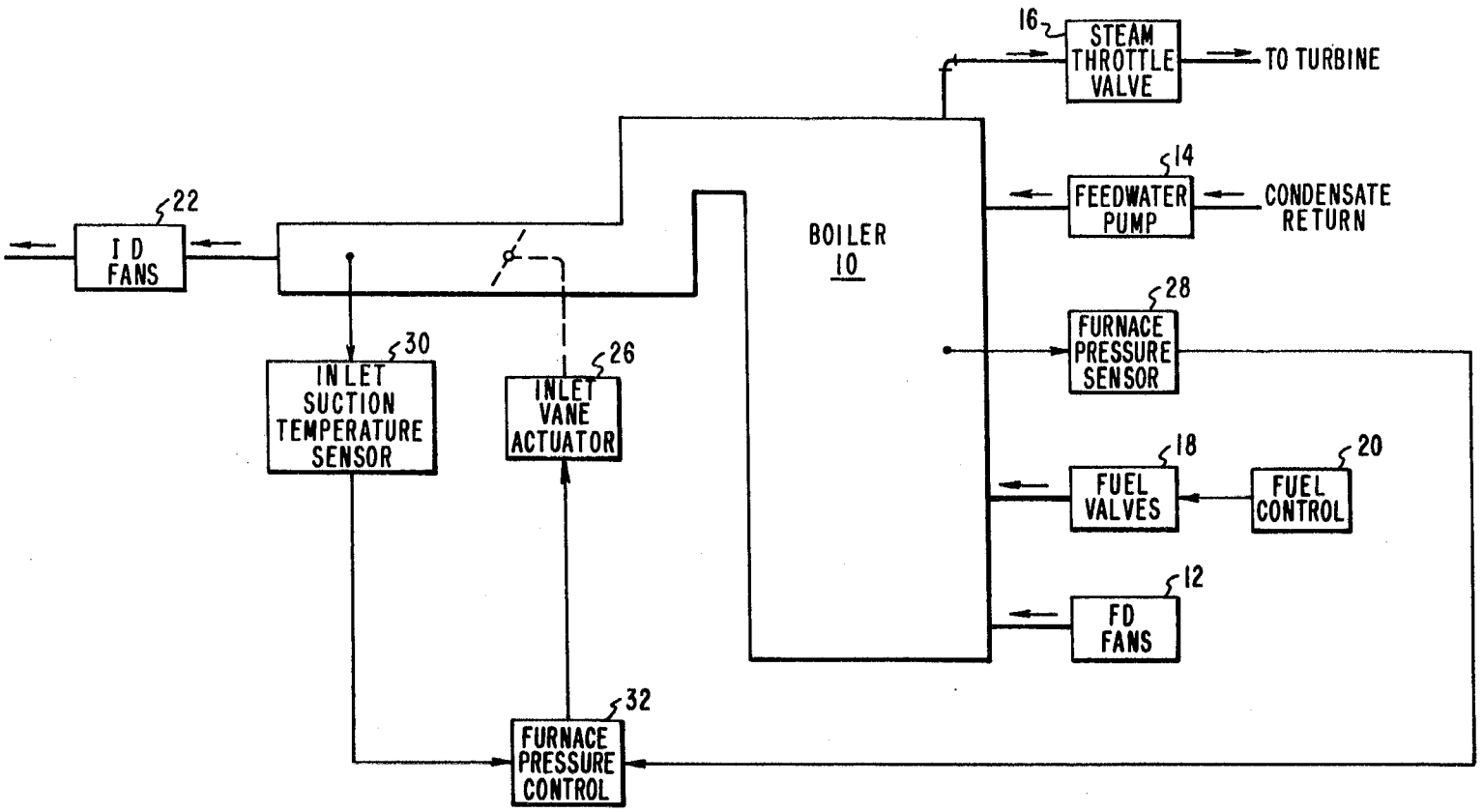
FIG. 1 shows a schematic view of a power plant boiler in which the invention is employed.

More particularly, there is shown in FIG. 1 a boiler 10 which generates steam for the operation of a steam turbine generator in an electric power plant. The furnace air supply includes that produced by one or more FD fans 12. Feedwater is supplied by a pump 14 and heated to become steam for outflow to the turbine through a throttle valve 16. Fuel is burned in the furnace combustion zone to produce the heat needed for steam production, and fuel valves 18 are positioned by a fuel control 20 to determine the pressure and temperature of the outlet steam under boiler startup and load conditions.

Air and combustion products are drawn from the boiler 10 by one or more ID fans 22. Inlet vanes 24 are provided to control the furnace pressure in response to an output from a conventional inlet vane actuator 26.

Figure 2:
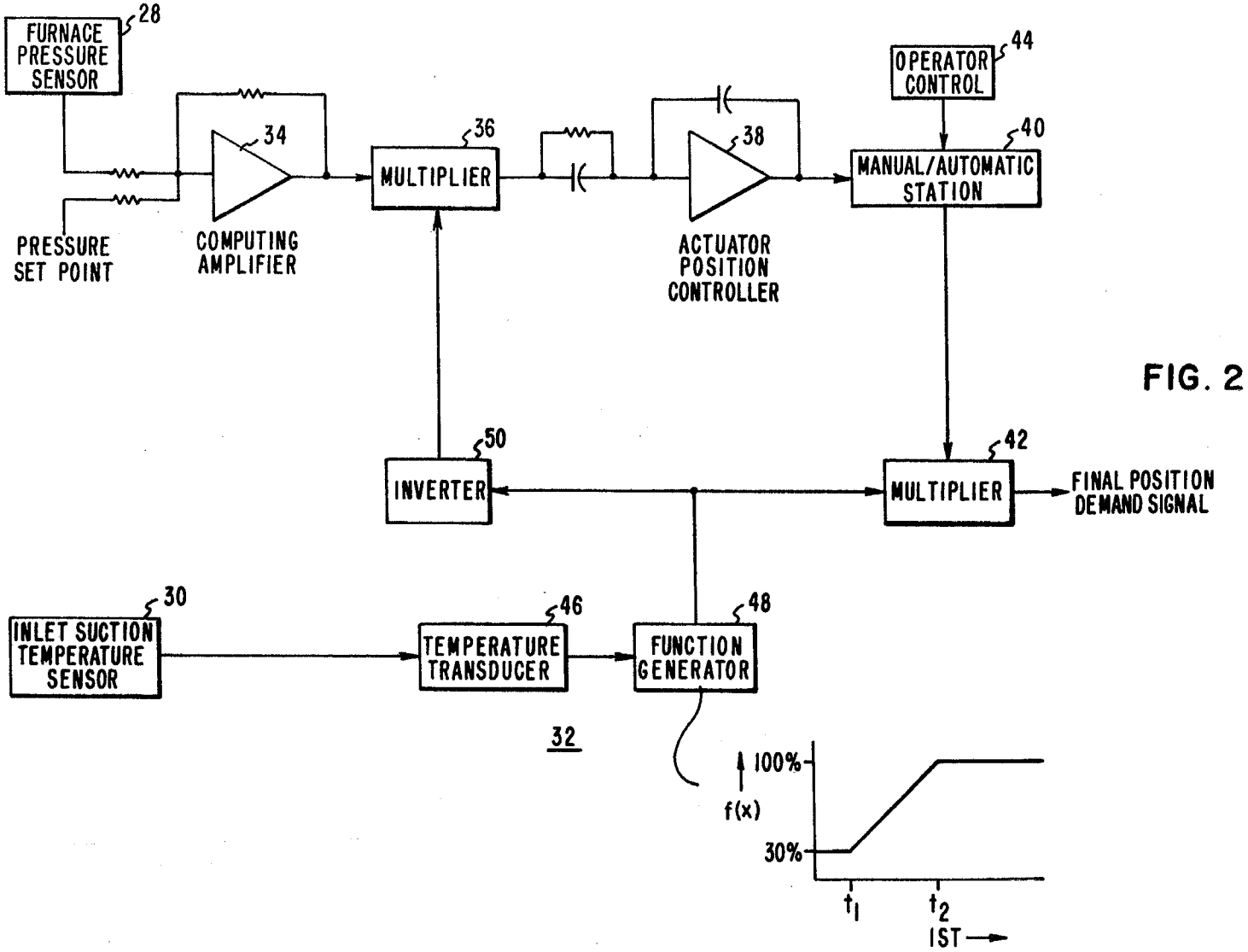
FIG. 2 shows a block diagram of a control system employed in implementing the invention.

A furnace pressure sensor 28 and an inlet suction temperature sensor 30 are employed in a control 32 which operates the inlet vane actuator 26. As shown in greater detail in FIG. 2, the furnace control 32 includes a computing amplifier 34 which compares the actual furnace pressure signal with a predetermined setpoint reference and generates an output pressure error signal. A suitable circuit for the amplifier 34 is that shown and described in a Westinghouse Electric Corporation bulletin entitled "7300 Series Analog Mixing Amplifier (NMA) Card" and dated April 1977.

The pressure error signal is preferably applied to a multiplier 36 and then to an actuator position controller 38. The multiplier 36 may be like that shown and described in a Westinghouse Electric Corporation bulletin dated June 1976 and entitled "7300 Series Multiplier/-Divider (NMD) Card". A suitable circuit for the controller 38 is shown and described in another Westinghouse bulletin dated Feb. 1977 and entitled "7300 Series Controller (NCB) Card".

A vane position control signal based on the pressure error signal is applied to a manual/automatic (M/A) station 40 and then preferably to another multiplier 42. The output from the multiplier 42 is the vane position demand signal applied to the vane actuator 26. A suitable circuit for the M/A station 40 is shown and described in another Westinghouse Electric Corporation bulletin dated Feb. 1977 and entitled "7300 Series Tracking Driver (NTD) Card".

In normal operation the pressure control loop just described is effective to hold the furnace pressure to the setpoint value with relatively small process error. During transient startup conditions, however, unsafe pressure overshoots or excursions can occur unless the furnace pressure is limited by some other means.

Preferably, the suction inlet temperature is sensed as an indicator of startup conditions. The output signal from the temperature sensor (thermocouple) 30 is applied to a transducer 46 which in turn is coupled to a function generator 48. The temperature transducer can be a circuit like that shown in Westinghouse Instruction Bulletin IB-101-828 dated January 1975 and entitled "Low Level Amplifier". The function generator 48 can be a circuit like that shown and described in a Westinghouse Bulletin dated April 1977 and entitled "7300 Series Function Generator (NCH) Card".

In order to provide improved stability of control loop operation, it is preferable that the inlet vanes position be limited as a function of inlet air temperature such that control loop gain is held substantially constant when limit action is being applied and when limit action is not being applied. This is achieved by reducing the gain downstream of the M/A station 40 and increasing the gain upstream of the M/A station to maintain constant overall loop gain.

The two multipliers are accordingly preferably employed to apply the pressure limit control while holding pressure control loop gain substantially constant. Thus, the limit signal from the function generator 48 is applied to the multiplier 42 as a multiplier (gain) factor which reduces the position demand to a limit value when air temperature is low during startup. The limit signal is also applied to another function generator circuit 50 like that employed by the function generator 48. However, the function generator 50 is connected as an inverter and its output is applied as a multiplier factor (gain) to the multiplier 36.

The net operation of the multipliers 36 and 42 is to hold the control loop gain at its characteristic value, i.e., to multiply it by one. For example, if the output of the function generator 48 is a 50% signal, the gain factor applied to the multiplier 36 is 2 and that gain factor applied to the multiplier 42 is 0.5. The net control loop gain multiplication is 1, while the inlet vane position is limited to 0.5 times the full open vane position.

Generally, as shown in the graphical illustration, the limited value f(x) is 30% at all air temperatures below $t_1$ and increases on a ramp to 100% at $t_2$. At temperatures above $t_2$, the limit is constant at 100%. The function generator 50 inverts the function f(x) over the operating range of inlet air temperatures to produce constant gain control loop operation as described above. During starting, the function f(x) results in the application of a limit within the range 0% to 30% as inlet air temperature rises. At all times, the limit is such that furnace pressure is restricted to a safe value at the operating inlet air temperature. The fact that the M/A station is upstream from the multiplier 42 results in pressure limit action in both the automatic and the manual modes of operation.

What is claimed is:

1. A control system for one or more boiler induced draft fans having positionable inlet vanes in an electric power plant comprising first means for generating a signal representative of actual furnace pressure, second means for generating a signal indicating the boiler is in a range of operation during the startup process in which the temperature of the furnace air outflow to the induced draft fans is in a low range resulting in a significant risk of hazardous furnace pressure excursions, means for generating a pressure error based on the difference between the actual furnace pressure and a reference furnace pressure, means for operating a position demand for controlling the position of the inlet vanes to control the furnace pressure to the reference value as a function of the pressure error, means for actuating the inlet vanes to the demand position, and means for limiting the inlet vane position during startup as a function of the startup indication signal from said second means.

2. A control system as set forth in claim 1 wherein said second means includes means for generating a signal representative of the temperature of inlet air to the induced draft fans.

3. A control system as set forth in claim 2 wherein said limit means includes means for generating a limit which decreases the limit action on the inlet vane position as the fan inlet air temperature increases during startup.

4. A control system as set forth in claim 3 wherein said limit means limits the inlet vanes to a predetermined percentage of full open position when the fan inlet air temperature is below a first value and limits the inlet vanes to an increasing percentage of full open position as the fan inlet air temperature rises during startup to a second higher value at which point the inlet vanes are limited to one hundred percent full open position.

5. A control system as set forth in claim 3 wherein first multiplier means multiplies the pressure error against a first gain factor with the output of said first multiplier means coupled to said position controlling means, second multiplier means for multiplying the position control demand against a second gain factor with the output of said second multiplier means coupled to an actuator for the inlet vanes, and means for coupling the limit as the second gain for said second multiplier means and an inversion of the limit as the first gain for said first multiplier means.

6. A control system as set forth in claim 5 wherein selection means are provided for operator selection of automatic furnace pressure control or operator furnace pressure control, said selection means coupled between said vane position controlling means and said second multiplier means.

7. A control system as set forth in claim 5 wherein a first function generator is provided for generating the limit as a function of the inlet air temperature and a second function generator is provided for generating the inversion of the limit.

8. A control system as set forth in claim 7 wherein said pressure error generating and multiplier and position controlling means and said function generators are in the form of hardware circuitry.

9. An induced draft fan system for an electric power plant boiler comprising one or more induced draft fans for drawing air and combustion products from the boiler furnace, inlet position vanes for controlling the flow opening in the cross-section of the air flow path, first means for generating a signal representative of actual furnace pressure, second means for generating a signal indicating the boiler is in a range of operation during the startup process in which the temperature of the furnace air outflow to the induced draft fans is in a low range resulting in a significant risk of hazardous furnace pressure excursions, means for generating a pressure error based on the difference between the actual furnace pressure and a reference furnace pressure, means for operating a position demand for controlling the position of the inlet vanes to control the furnace pressure to the reference value as a function of the pressure error, means for actuating the inlet vanes to the demand position, and means for limiting the inlet vane position during startup as a function of the startup indication signal from said second means.

10. A system as set forth in claim 9 wherein said second means includes means for generating a signal representative of the temperature of inlet air to the induced draft fans wherein said limit means includes means for generating a limit which decreases the limit action on the inlet vane position as the fan inlet air temperature increases during startup.

* * * * *